US005406998A

United States Patent [19]

Christiansen

[11] Patent Number: 5,406,998

[45] Date of Patent: Apr. 18, 1995

[54] SUPPORT FOR HANGING FABRIC OR THE LIKE

[76] Inventor: Sandra L. Christiansen, 4139 Via Marina, #1203, Marina del Rey, Calif. 90292

[21] Appl. No.: 168,814

[22] Filed: Dec. 16, 1993

[51] Int. Cl.[6] ..... A47H 1/00

[52] U.S. Cl. ..... 160/330; 160/352; 248/262

[58] Field of Search ..... 160/330, 134, 84.1 F, 160/352; 248/262

[56] References Cited

U.S. PATENT DOCUMENTS

| | | | |
|---|---|---|---|
| 1,313,915 | 8/1919 | Robinette . | |
| 1,406,311 | 2/1922 | Wendel . | |
| 1,518,963 | 12/1924 | Civis . | |
| 1,609,877 | 12/1926 | Kendall | 160/134 |
| 1,652,662 | 12/1927 | Dover et al. | 211/105.2 |
| 1,786,645 | 12/1930 | Dover | 211/105.2 X |
| 2,261,142 | 11/1941 | Davis . | |
| 2,266,854 | 12/1941 | Davis . | |
| 2,460,517 | 2/1949 | Lundstrom | 211/105.2 |
| 2,617,537 | 11/1952 | Henley | 211/105.2 |
| 2,622,743 | 12/1952 | Ross | 211/105.2 X |
| 3,064,724 | 11/1962 | Nowell . | |
| 3,346,227 | 9/1963 | Hankin . | |
| 3,140,071 | 7/1964 | Lorentzen . | |
| 4,825,611 | 5/1989 | Bassett | 160/84.1 F X |
| 5,028,027 | 7/1991 | Fraser | 248/262 |
| 5,044,418 | 9/1991 | Donahue | 160/84.1 F X |
| 5,219,407 | 6/1993 | Herring | 160/330 |

FOREIGN PATENT DOCUMENTS

| | | | |
|---|---|---|---|
| 657177 | 9/1951 | United Kingdom | 211/105.2 |
| 902831 | 8/1962 | United Kingdom | 211/105.2 |

*Primary Examiner*—Blair M. Johnson
*Attorney, Agent, or Firm*—Snell & Wilmer

[57] ABSTRACT

A support for hanging fabric in a substantially closed loop shape. A bracket comprising two laterally spaced legs extending upwardly from the lower edge of a backplate thereby forming a pair of upwardly opening channels. A frame having a curved primary portion and attachment portions on each end thereof is supported by engagement between the attachment portions and the bracket.

4 Claims, 2 Drawing Sheets

SUPPORT FOR HANGING FABRIC OR THE LIKE

FIELD OF THE INVENTION

The present invention relates generally to a support for hanging fabric, such as a curtain, canopy, or the like, and more particularly, to a support for hanging fabric in a substantially closed loop shape.

BACKGROUND OF THE INVENTION

In general, supports for fabric, such as curtains or the like, are known. An example of such a support is described in U.S. Pat. No. 5,028,027 issued to T. A. Fraser on Jul. 2, 1991.

The prior art supports, however, are relatively complex, and expensive to manufacture. For example, in the device described in the Fraser '027 patent, the support consists of a bracket and frame; the frame includes two interconnected straight ends which are joined by a dovetail connection. Such a connection is disadvantageous both in manufacture and use. In particular, the dovetail joint requires complex and expensive die cuts in manufacture, as well as detailed attention to manufacturing tolerances. In the event those tolerances are not strictly adhered to, connection of the straight ends during use of the support becomes difficult, if not impossible.

SUMMARY OF THE INVENTION

The present invention provides a support for hanging fabric in a substantially closed loop shape, which is simply and inexpensively manufactured. Moreover, in use, the simple construction of the support in accordance with the present invention overcomes the disadvantages associated with similar prior art devices.

In addition, the present invention provides a method for using the novel support which includes the steps of mounting a bracket to a substantially flat surface (i.e., a wall), providing a frame having a substantially closed-loop shape, affixing fabric, such as a curtain or other like material to the frame, and affixing the frame to the bracket to form a decorative wall treatment.

BRIEF DESCRIPTION OF THE DRAWING

An exemplary embodiment of the present invention will be hereinafter described in conjunction with the figures of the appended drawing, wherein like designations denote like elements and.

DETAILED DESCRIPTION OF THE PREFERRED EXEMPLARY EMBODIMENT

Figure 1:
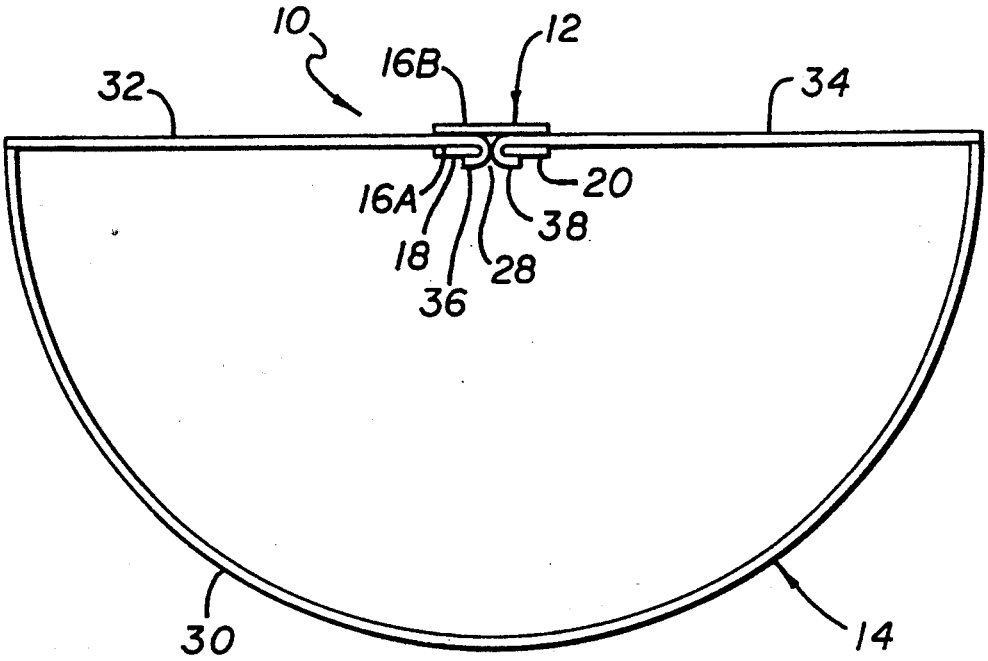
FIG. 1 is top view of a preferred embodiment of a support in accordance with the present invention.

Referring to FIG. 1, a support 10 for hanging fabric in a substantially closed-loop shape in accordance with the present invention comprises a mounting bracket 12, and a frame 14.

Figure 2:
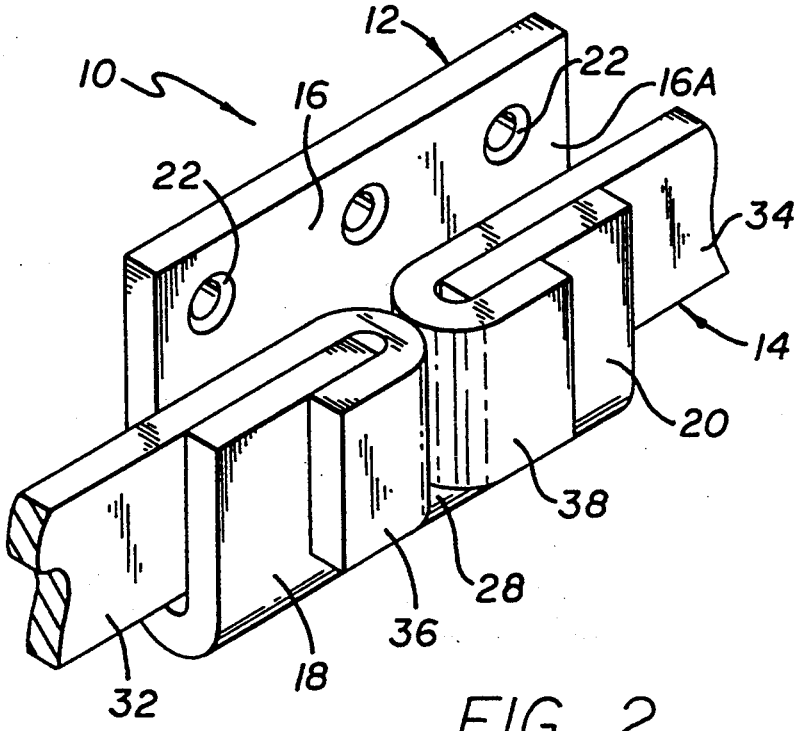
FIG. 2 is a perspective view of the mounting bracket and attachment portions of the support of FIG. 1.
Figure 3:
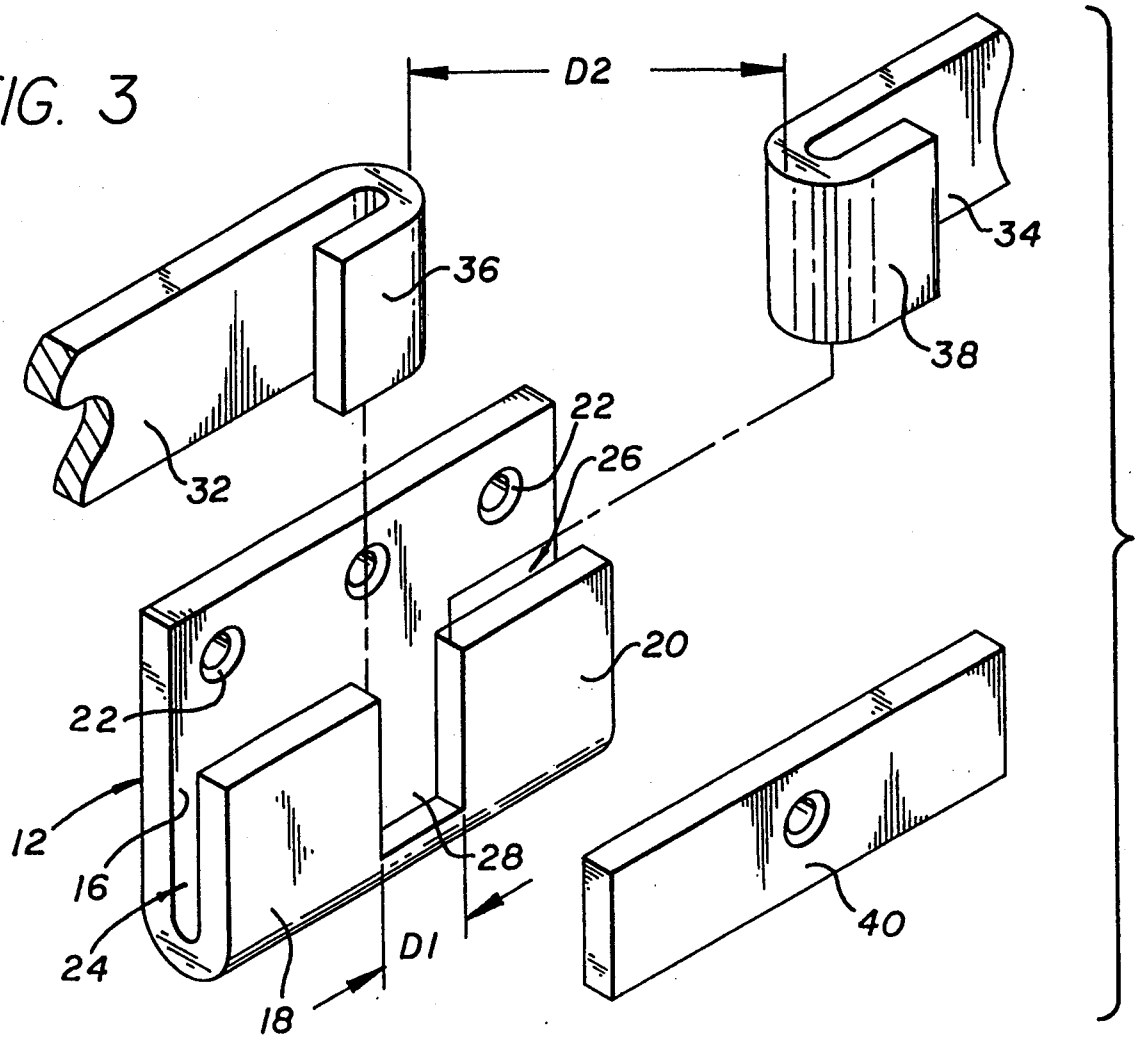
FIG. 3 is an exploded perspective view of the support of FIGS. 1 and 2, further including an additional closure element.

As best seen in FIGS. 2 and 3, bracket 12 preferably comprises a backplate 16 and respective legs 18 and 20. Back plate 16 is generally a planer with respective front and rear surfaces 16A and 16B, and a predetermined number of apertures 22 provided therethrough. Preferably, bracket 12 includes at least two (2) apertures 22 each of which being suitably counterbored to accommodate flat head fasteners, e.g., screws (not shown), for mounting bracket 12 to a substantially vertical surface, such as a wall.

In accordance with a preferred embodiment of the present invention, legs 18 and 20 extend from the lower edge of a backplate to form respective upwardly opening channels 24 and 26 (as best seen in FIG. 3). Backplate 16 and legs 18 and 20 are suitably formed as an integral unit; all three elements are suitably formed from a single sheet of metal or other suitable material, such as by cutting a notch 28 in the sheet to define legs 18 and 20, then bending legs 18 and 20 to form channels 24 and 26.

Preferably, backplate 16 is of a predetermined length, for example, about three inches (3"), with legs 18 and 20 disposed with outer edges overlying the outer edges of plate 16. Legs 18 and 20 are preferably of a predetermined longitudinal width, for example, about one and one-quarter inch (1¼") with the interior lateral edges disposed in spaced-apart relation by a predetermined distance, preferably the width of notch 28. In accordance with a particularly preferred aspect of the present invention, notch 28 has a width of about one-half inch (½") (designated as D-1). Channels 24 and 26 are also preferably of a predetermined depth, e.g., of about one inch (1"), generally corresponding to the height of frame 14, as will be explained. Bracket 12 preferably comprises a resilient material, such as metal. In accordance with a particularly preferred aspect of the present invention, bracket 12 is formed from cold rolled steel.

Frame 14 preferably comprises a primary portion 30 (FIG. 1), and respective attachment portions 32 and 34. Primary portion 30 is suitably arcuate, or curved, but may be any shape cooperating with attachment portions 32 and 34 to define a substantially closed-loop. As shown best in FIG. 1, attachment portions 32 and 34 preferably extend from the distal ends of primary portion 30, extending toward each other along a generally straight line.

With continued reference to FIG. 1, when assembled and attached to bracket 12, primary portion 30 and attachment portions 32 and 34 of frame 14 suitably cooperate to form a substantially "D"-shaped configuration. In such configuration, primary portion 30 forms the arcuate portion of the "D" and attachment portions 32 and 34 cooperate with bracket 12, as will be described hereinbelow, to form the straight portion of the "D".

In accordance with a particularly preferred embodiment of the present invention, at least a part or segment of each of attachment portions 32 and 34 are configured to be received in channels 24 and 26, and each includes an outwardly extending protrusion 36, 38, preferably at the distal end thereof. More particularly, as shown best in FIG. 2, outwardly extending protrusions 36 and 38, as will be discussed below, suitably cooperate with legs 18 and 20 in the region of notch 28 so as to secure frame 14 to bracket 12 and to fix attachment portions 32, 34 to bracket 12.

In accordance with a preferred aspect of the present invention, frame 14 is suitably formed of a strip (band) of resilient material, for example metal, bent to form primary portion 30, attachment portions 32 and 34, and projections 36 and 38. Preferably, frame 14 including such portions is formed from a lightweight metal or plastic. More preferably, frame 14 is formed from lightweight high-strength aluminum.

Frame 14 preferably has a predetermined width, for example, of about one inch (1"), and a predetermined thickness, for example, of about one-eighth inch ($\frac{1}{8}$"), sufficient to provide the necessary rigidity, yet also sufficient to hold to weight of the fabric or curtain affixed thereto, without any significant bending.

Primary portion 30 suitably biases, through a spring action, the ends of attachment portions 32 and 34 away from each other, such that, when in a relaxed state, the ends of attachment portions 30 and 32 are separated by a distance D2. As can be seen best in FIG. 3, preferably distance D2 is greater than distance D1 between the adjacent sides of legs 18 and 20. The larger distance D2 facilitates the threading or looping of a fabric or curtain on to frame 14 and ensures that frame 14 is suitably retained in bracket 12 when in use.

In assembly, primary portion 30 of frame 14 is compressed so that attachment portions 32 and 34 may be received in channels 24 and 26, with protrusions 36 and 38 disposed between the adjacent lateral edges of legs 18 and 20. Primary portion 30 thus biases projections 36 and 38 towards, and preferably against, the lateral edges of legs 18 and 20.

In use of support 10, bracket 12 is preferably first mounted on a substantially vertical surface, such as a wall, by fasteners extending through apertures 22. Thereafter, with frame 14 separated from bracket 12, and in a relaxed state, fabric, such as a curtain or canopy, is threaded or looped onto frame 14. Once the fabric is suitably adhered to frame 14, frame 14 is then compressed, and mounted within bracket 12 such that attachment portions 32 and 34 are received in channels 24 and 26 with protrusions 36 and 38 between the lateral edges of legs 18 and 20. Generally, the cooperation between legs 18 and 20, and attachment portions 32 and 34 are sufficient to maintain frame 14 extending outwardly from the wall to which bracket 16 is mounted. The relative dimensions of attachment portions 32 and 34 and channels 24 and 26 prevent frame 14 from turning within the channel, and the depth of channels 24 and 26 are suitably sufficient to prevent attachment portions 32 and 34 from being turned out of the channels. As previously noted, frame 14 is preferably formed of a metal strip of sufficient width an thickness to withstand the torque resulting from the weight of the curtain or fabric on frame 14. Likewise, legs 18 and 20 are designed to be of sufficient strength to withstand that torque without bending.

If desired, a closure element 40 (FIG. 3) can be employed to more affirmatively secure attachment portions 32 and 34 in channels 24 and 26. Element 40 is suitably a block of relatively light material, such as plastic, which attached, e.g., by a screw, to bracket 16 overlying the upper longitudinal edge of legs 18 and 20. Protrusions 36 and 38 prevent longitudinal forces from pulling attachment portions 32 and 34 out of slots 24 and 26.

It will be understood that the above description is of preferred exemplary embodiment of the present invention, and the invention is not limited to the specific forms shown. For example, obviously the dimensions of the device may be altered and/or the specific configuration of the frame modified. These and other modifications may be made in the design and arrangement of the elements within the scope of the invention, as expressed in the claims.

I claim:

1. A support for hanging fabric, the support being of the type including a frame and a mounting bracket, improved wherein: said bracket comprises a backplate and first and second legs;

said backplate being generally planar and having forward and rear surfaces, a longitudinal lower edge, and at least one aperture therethrough;

said first leg extending from said backplate lower edge, bent to form a first upwardly opening channel, said first leg having first and second lateral edges and a longitudinal top edge;

said second leg extending from said backplate lower edge, bent to form a second upwardly opening channel, said second leg having first and second lateral edges and a longitudinal top edge;

said first and second legs being disposed such that the adjacent lateral edges of said first and second legs are spaced apart from each other by a first predetermined distance;

and wherein said frame comprises resilient material bent into primary portion and first and second attachment portions;

said first and second attachment portions extending towards each other along a generally straight line, each of said attachment portions including a portion configured to be received in said mounting bracket channels and an outwardly extending protrusion at the distal end thereof; said frame being configured to form, when said frame is in assembly with said mounting plate, a substantially closed loop with said portions of said attachment portions received in said mounting bracket channels, and said outwardly extending protrusions disposed between and biased toward the adjacent lateral edges of said mounting bracket first and second leg portions.

2. A support for hanging fabric, the support being of the type including a frame and a mounting bracket, improved wherein:

said bracket comprises:

a generally planar backplate portion having forward and rear surfaces, a longitudinal lower edge, and at least one aperture therethrough;

a first foot portion extending outwardly from said backplate portion and a first leg portion extending upwardly from said first foot portion, offset from said backplate to form a first upwardly opening channel, said first leg portion having first and second lateral edges and a longitudinal top edge;

a second foot portion extending outwardly from said backplate portion, and a second leg portion extending upwardly from said second foot portion, offset from said backplate to form a second upwardly opening channel, said second leg having first and second side edges and a top edge;

the adjacent lateral edges of said first and second leg portions being spaced apart from each other by a first predetermined distance;

and wherein said frame comprises a primary portion and first and second attachment portions;

said first and second attachment portions extending towards each other along a generally straight line, each of said attachment portions including a portion configured to be received in said mounting bracket channels and an outwardly extending protrusion at the distal end thereof;

said frame being configured to form, when said frame is in assembly with said mounting plate, a substantially closed loop, with said portions of said attachment portions received in said mounting bracket channels, and said outwardly extending protrusions disposed between the adjacent lateral edges of said mounting bracket first and second leg portions.

3. The support for hanging fabric of claim 2 wherein said frame is formed of resilient material such that said attachment portion protrusions are biased toward said mounting plate leg lateral edges.

4. A method for making a decorative wall treatment, the method comprising the steps of:

providing a frame comprising a primary portion and first and second attachment portions, said first and second attachment portions extending towards each other and each including an outwardly extending protrusion at the distal end thereof;

attaching fabric material to said frame such that it substantially covers said primary portion and said first and second portions of said frame;

providing a bracket comprising a generally planar backplate portion having forward and rear surfaces, a longitudinal lower edge, and at least one aperture therethrough, a first leg extending from said backplate lower edge, bent to form a first upwardly opening channel, a second leg extending from said backplate lower edge, bent to form a second upwardly opening channel, said first and second legs being disposed such that the adjacent lateral edges of said first and second legs are spaced apart from each other by a first predetermined distance;

affixing said bracket to a wall; and affixing said frame to said bracket such that said protrusions of said frame are disposed between said first and second legs of said bracket and said first and second attachment portions of said frame are maintained in said first and second channels of said bracket.

* * * * *